United States Patent [19]

Weiss et al.

[11] 3,982,071

[45] Sept. 21, 1976

[54] MULTICHANNEL SOUND SIGNAL PROCESSING SYSTEM EMPLOYING VOLTAGE CONTROLLED AMPLIFIERS

[76] Inventors: Edward A. Weiss, 322 N. Princeton Ave., Villa Park, Ill. 60181; Harvey A. Brodsky, 9440 Lincolnwood Ave., Evanston, Ill. 60203

[22] Filed: Aug. 20, 1974

[21] Appl. No.: 499,029

[52] U.S. Cl. ..... 179/1 GQ; 179/1 GP; 179/100.4 ST

[51] Int. Cl.[2] ..... H04R 5/00

[58] Field of Search ..... 179/1 GP, 1 G, 1 GQ, 179/1 B, 1 J, 1 AT, 100.4 ST, 100.1 TD; 84/1.24; 331/64

[56] References Cited

UNITED STATES PATENTS

| | | | |
|---|---|---|---|
| 3,710,034 | 1/1973 | Murry | 179/1 G |
| 3,757,046 | 9/1973 | Williams | 179/1 GQ |

*Primary Examiner*—Douglas W. Olms
*Attorney, Agent, or Firm*—Hill, Gross, Simpson, Van Santen, Steadman, Chiara & Simpson

[57] ABSTRACT

A circuit for controlling the application of one or more audio signals to a plurality of channels incorporates a series of voltage controlled amplifiers for interconnecting an individual signal source with different channels at different times, and a control apparatus for selectively energizing the voltage controlled amplifiers in a selected sequence and at selected times so that the signal can be applied successively to the channels in accordance with the selected pattern or program. A second plurality of voltage controlled amplifiers are provided to accomplish the same function with respect to a second signal source, and the program for the energization of the second group of voltage controlled amplifiers may be the same or different from the first program. When the channels are connected to four loudspeakers, placed at four corners of a square, an unusual acoustic effect is produced, by which the two signal sources seem to a listener to move about the room as the various voltage controlled amplifiers are energized. When the channels are connected to multichannel recording apparatus, the effects are produced by conventional quadraphonic reproduction techniques on playback. The processing of the present invention may also be performed during playback of a recording made using the present invention, with unusual acoustic effects.

20 Claims, 2 Drawing Figures

MULTICHANNEL SOUND SIGNAL PROCESSING SYSTEM EMPLOYING VOLTAGE CONTROLLED AMPLIFIERS

BACKGROUND

1. Field of the Invention

The present invention relates to a sound signal processing system, and more particularly, to such a system which is adapted to modulate a plurality of output channels with one or more signal sources.

2. The Prior Art

In recent years, multichannel sound reproduction has gained in popularity, at least partially for the reason that multichannel systems are capable of producing sound effects which cannot be produced by a single channel, or even two channels. When three or more channels are used, it is possible to represent more accurately the spatial distribution of the original sound sources. When the channels are connected to loudspeakers placed in an appropriate spatial distribution, special sound effects are produced and may be observed by a listener within the room. These effects cannot be produced with a lesser number of loudspeakers.

Although much has been done in furtherance of faithful reproduction of sound signal sources, little attention has heretofore been given to special effects which can be produced with multichannel systems, and, as a result, multichannel systems have not yet had their full potential explored. It is therefore desirable to produce a system in which the capabilities of a multichannel sound processing system are utilized more completely.

SUMMARY OF THE PRESENT INVENTION

It is a principal object of the present invention to provide a method and apparatus for creating unusual acoustic effects employing a multichannel sound processing system.

Another object of the present invention is to provide a method and apparatus for sequentially energizing individual ones of a plurality of channels, so that a single input source may appear to move its spatial position.

A further object of the present invention is to provide such a system in which two sound signal sources are provided and are manipulated independently in such a manner as to appear to move their spatial positions in different directions and/or at different rates.

These and other objects of the present invention will become manifest upon an inspection of the following description and the accompanying drawings.

In one embodiment of the present invention there is provided a plurality of voltage controlled amplifiers, each associated with one of a plurality of channels, and control means for sequentially selecting said voltage controlled amplifiers for operation, whereby said loudspeakers are energized in sequence, so that a single signal source connected in common to a signal input of all of said voltage controlled amplifiers is coupled sequentially to said loudspeakers, producing an apparent change in the physical position of the reproduced sound source.

BRIEF DESCRIPTION OF THE DRAWINGS

Reference will now be made to the accompanying drawings, in which.

DESCRIPTION OF THE PREFERRED EMBODIMENTS

Figure 1:
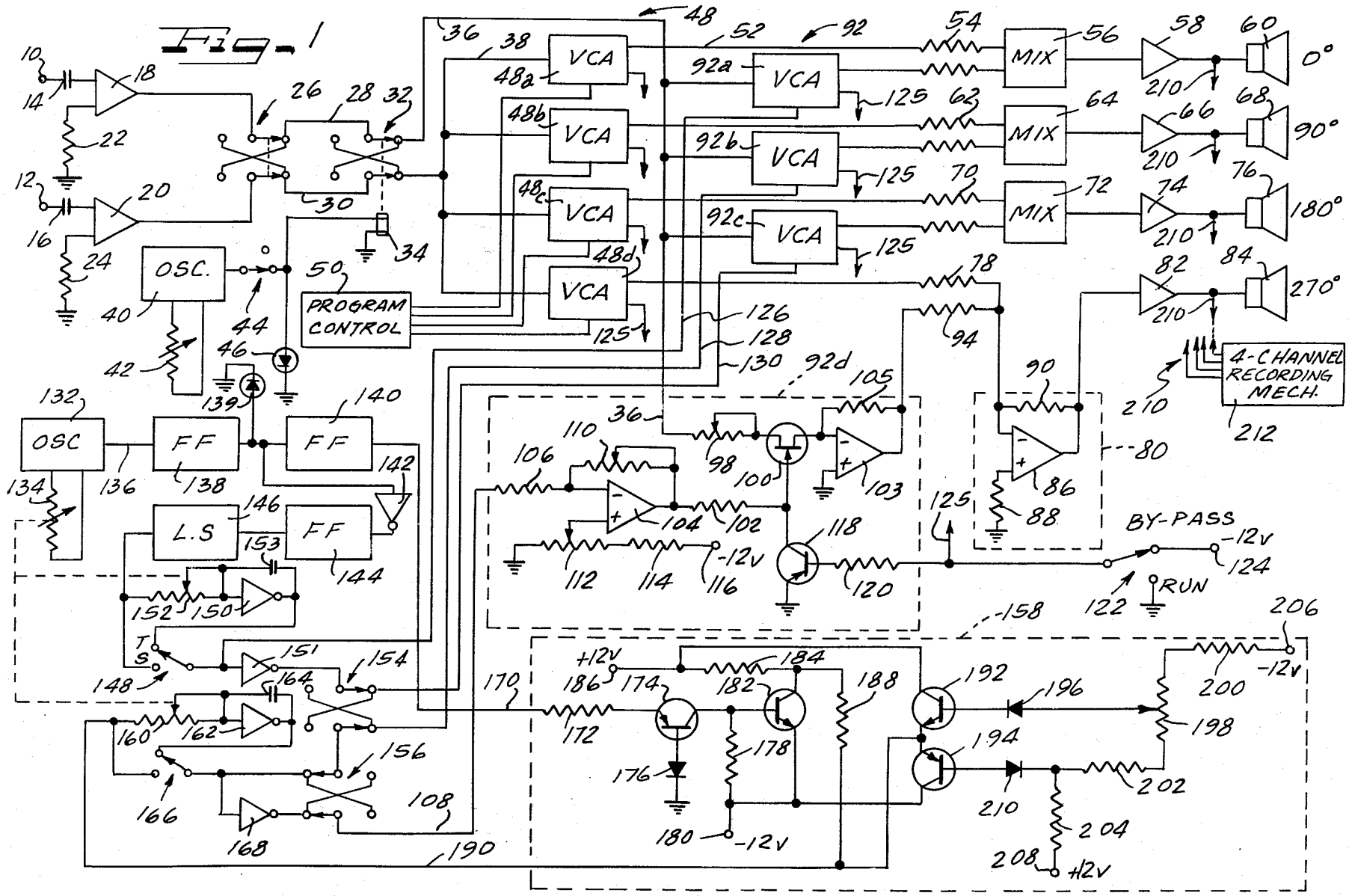
FIG. 1 is a functional block diagram illustrating an illustrative embodiment of the present invention.

Referring now to FIG. 1, two input terminals 10 and 12 are provided which are each connected through individual capacitors 14 or 16, respectively, to an input of an amplifier 18 or 20, respectively. The other input of each of the amplifiers 18 and 20 is connected to ground through a resistor 22 or 24, respectively, and the outputs of the two amplifiers 18 and 20 are connected to the two common terminals of a double-pole, double-throw switch 26.

The switch 26 is connected to two output lines 28 and 30, connected to opposite terminals of each pole of the switch, and, when the switch is in the position shown in FIG. 1, the output of the amplifier 18 is connected to the line 28 and the output of the amplifier 20 is connected to the line 30. When the switch 26 is moved to its other position, the connections of the amplifiers 18 and 20 with the lines 28 and 30 are reversed.

The lines 28 and 30 are connected to the two common terminals of a double-pole, double-throw relay operated switch 32. The switch 32 is shown in its normal condition, with the relay coil 34 unactuated, in which the line 28 is connected to an output line 36 and the line 30 is connected to an output line 38. When the relay coil 34 is actuated, the switch 32 is reversed, so that the interconnections of the lines 28 and 30 with the lines 36 and 38 are reversed.

The relay coil 34 is operated by an oscillator 40, the frequency of operation of which is controlled by a variable resistor 42. The output of the oscillator 40 is connected through a single-pole, single-throw switch 44 through the relay coil 34, so that when the switch 44 is closed, the relay coil 34 is operated repeatedly during alternate half-cycles of the signal produced by the oscillator 40. When the switch 44 is open, the relay coil 34 remains de-energized and the switch 32 remains in the condition shown in FIG. 1. A light emitting diode (or LED) 46 is connected across the coil 34 to visually indicate when the relay coil 34 is energized.

The line 38 is connected to the signal input of each of a first group 48 of voltage controlled amplifiers. The group 48 includes amplifiers 48*a*, 48*b*, 48*c*, and 48*d*. Each of the amplifiers in the group 48 has its control input connected to an individual output of a program control unit 50, the construction and operation of which is described in more detail hereinafter. The amplifiers 48 are controlled in sequence so that they sequentially connect the input line 38 to the individual output lines of the amplifiers 48.

The amplifier 48*a* has an output line 52 which is connected through an isolation resistor 54 to an input of a mixer 56. The output of the mixer 56 is connected through an amplifier 58 to a loudspeaker 60. The loudspeaker 60 is sometimes hereinafter referred to as the 0° position loudspeaker, relating the spatial position of the loudspeaker 60 to the other loudspeakers in the system. The output of the amplifier 48*b* is connected through an isolation resistor 62 to an input of a mixer 64, the output of which is connected through an amplifier 66 to a loudspeaker 68. The loudspeaker 68 is sometimes hereinafter referred to as the 90° loudspeaker.

The output of the amplifier 48*c* is connected through an isolation resistor 70 to an input of a mixer 72. The output of the mixer 72 is connected through an amplifier 74 to the 180° loudspeaker 76.

The output of the amplifier 48*d* is connected through an isolation resistor 78 to an input of a mixer 80, the output of which is connected through an amplifier 82 to the 270° loudspeaker 84.

The construction of all of the mixers 56, 64, 70, and 80 is identical, and is illustrated for the mixer 80. The resistor 78 is connected to an inverting input of an amplifier 86, which has its noninverting input connected to ground through a resistor 88. A feedback resistor 90 is connected from the output of the amplifier 86 to its inverting input and serves to establish the gain of the amplifier.

A second group 92 of voltage controlled amplifiers includes amplifiers 92*a*, 92*b*, 92*c*, and 92*d*. Each of them has an isolation resistor, such as the resistor 94 associated with the amplifier 92*d*, which is connected to the input of its associated mixer. The signal input of all of the voltage controlled amplifiers 92 is connected in common to the line 36. Each of the mixers 56, 64, 72, and 80 serves to mix a signal derived from one of the input terminals 10 with a signal derived from the other input terminal 12. The time at which the two signals are presented to the inputs of the mixers depends upon the programs which control operation of the voltage controlled amplifiers in the groups 48 and 92.

The construction of each of the voltage controlled amplifiers is identical, and is illustrated in the case of the amplifier 92*d*. The signal input line 36 is connected through a rheostat 98 and through a field effect transistor (or FET) 100 to the inverting input of an amplifier 103. The amplifier 103 has a feedback resistor 105 connected between its output and its inverting input, and its output is connected directly to the isolation resistor 94. The gate of the FET 100 is connected through a resistor 102 to the output of an amplifier 104. The inverting input of the amplifier 104 is connected through a resistor 106 to a line 108, which furnishes a program control input, as hereinafter described. A variable resistor 110 is connected between the output of the amplifier 104 and its inverting input to establish a gain of the amplifier. The bias of the amplifier is controlled by a potentiometer 112, which is connected in a series circuit with another resistor 114 between ground and a source of potential at a terminal 116. In a preferred embodiment, the potential supplied to the terminal 116 is −12 V. The tap of the potentiometer 112 is connected to the noninverting input of the amplifier 104. The potentiometer 112 is adjusted to give the desired quiescent operating characteristics of the FET 100, and the potentiometer 110 is adjusted to select the gain of the amplifier 104, so the FET can be varied from near cut off to near full conduction with each cycle of operation of the signal applied to the control input over the line 108. The rheostat 98 is adjusted for individual voltage controlled amplifiers so as to bring about equal amplitude signals at the inputs of the several mixers 56, 64, 72, and 80.

The amplifier 104 is provided for controlling the potential of the gate of the field effect transistor 100. When the potential on the line 108 is high, the potential at the output of the amplifier 104 is low, and the FET 100 is substantially cut off, so that substantially no signal is transmitted through the resistor 94. When the potential on the control line 108 is low, however, a low potential is presented to the gate of the FET 100, which serves to increase the conductance of the FET between its drain and source terminals, thereby connecting the line 36 to the input of the amplifier 103 and transmitting an amplified signal through the resistor 94.

Another transistor 118 has its collector connected to the gate of the field effect transistor 100 and its emitter connected to ground. Its base is connected through a resistor 120 to the common terminal of a switch 112. The switch 112 is a single-pole, double-throw switch. One of its two uncommon terminals is connected to ground, while the other is connected to a terminal 124, to which is connected a source of potential, preferably −12 V. When the switch 112 is in its condition shown in FIG. 1, a negative potential is applied to the base of the transistor 118, which causes the transistor 118 to be conductive and holds the potential of the gate of the field effect transistor 100 near ground potential. In this way, the field effect transistor 100 remains conductive, and the voltage controlled amplifier 92*d* is held "on" and does not function to disconnect the signal line 36 from the mixer 80. When the switch 122 is in its other position, however, the transistor 118 is cut off by holding its base at ground potential, so that it does not interfere with the control of the field effect transistor 100 by the amplifier 104.

The common terminal of the switch 122 is also connected by lines 125 to corresponding inputs of all of the other voltage controlled amplifiers in the groups 48 and 92, so that when programmed operation is desired to be by-passed, all of the amplifiers in the groups 48 and 92 are controlled by operation of the single switch 122. Alternatively, two such switches may be provided for independently controlling the two groups of amplifiers 48 and 92.

The control lines 108, 126, 128, and 130 associated with the voltage controlled amplifiers of the group 92 are connected to the four outputs of a control unit like the control unit 50. The construction of the control units will now be described.

An oscillator 132 operates at a frequency which is selected by means of a variable resistor 134. Its output is connected by a line 136 to the input of a flip-flop 138. The flip-flop 138 functions to square the signal produced by the oscillator 132, so as to produce at its output a square wave having equal during half cycles. The square wave is connected directly to the input of a further flip-flop 140 and through an inverter 142 to the input of another flip-flop 144. The outputs of the flip-flop 138, the inverter 142, and the flip-flops 140 and 144 are shown respectively as wave forms a-d in FIG. 2. An LED 139 is connected to the output of the flip-flop 138 to visually indicate its operating frequency.

The flip-flop 144 has its output connected through a lever shifter device 146 to one uncommon terminal of a single-pole, double-throw switch 148. The common terminal of the switch is connected to the control line 126. The other uncommon terminal of the switch 148 is connected to the output of an amplifier 150 is derived from the output of the level shifter 146 through a variable resistor 151. The amplifier 150 has a capacitor 153 connected between its input and output, so that it functions as an integrator, producing an integrated and inverted signal at its output relative to its input. Accordingly, the output of the amplifier 150 is a triangular wave, having the same frequency as the square wave which is supplied at the output of the level shifter 146. The variable resistor 151 is adjusted to select the rate of integration of the input square wave, to give a large amplitude triangular wave form. The switch 48 selects either the square wave or the triangular wave for connection to the control line 126.

An inverter 151 has its input connected to the common terminal of the switch 148 and its output connected to one common terminal of a double-pole, double-throw switch 154. The other common terminal of the switch 154 is connected to one common terminal of a double-pole, double-throw switch 156, and the second common terminal of the switch 156 is connected to the control line 108.

The output of the flip-flop 140 is connected through a level shifter 158, which is identical to the level shifter 146, and then through a variable resistor 160 to the input of an inverter 162, which has a capacitor 164 interconnected between its output and its input to function as an integrator. The output of the inverter-integrator 162 is connected to one uncommon terminal of a single-pole, double-throw switch 166, while the other uncommon terminal is connected directly to the output of the level shifter 158. The common terminal of the switch 166 is connected to the input of an inverter 168, which functions to invert the signal. The common terminal of the switch 166 and the output of the inverter are connected, respectively, to opposite poles of the two sections of the switch 156, so that the common terminal of the switch 166 and the output of the inverter 168 may alternately be connected to the line 108 and to a common terminal of the switch 154. The reversing switch 154 functions to selectively reverse the connections, to the control lines 128 and 130, of the line from a common terminal of the switch 156 and the output of the amplifier 151. The variable resistors 160 and 152 are ganged with the variable resistor 134, to provide the same peak-to-peak value for the triangular wave form, irrespective of the frequency of operation of the oscillator 132.

A schematic diagram of the level shifter 158, which is identical to the level shifter 146, is illustrated in FIG. 1. The output of the flip-flop 140 is connected by a line 170 through an input resistor 172 to the emitter of a transistor 174. The base of the transistor 174 is connected to ground by a diode 176, and its collector is connected through a load resistor 178 to a source of negative potential at a terminal 180. The collector of the transistor 174 is also connected to the base of the transistor 182, which has its collector connected through a resistor 184 to a source of positive voltage at a terminal 186, and through a resistor 188 to an output line 190. The line 190 is connected to one uncommon terminal of the switch 166 and to the variable resistor 160, as described above.

The potential on the line 190 is clamped by means of a clamping circuit including transistors 192 and 194. The transistor 192 is an npn transistor having its collector connected to the terminal 186 and its emitter connected to the emitter of the transistor 194, which is a pnp transistor. The collector of the transistor 194 is connected to the terminal 180. A diode 196 is connected between the base of the transistor 192 and the tap of a potentiometer 198, which forms part of a voltage divider including resistors 200, 202, and 204, connected between positive and negative sources of potential applied to terminals 206 and 208. A diode 210 connects the base of the transistor 194 to the junction of the resistors 202 and 204.

When the potential on the line 190 increases above a predetermined level, established at the junction of resistors 202 and 204, the transistor 194 conducts, clamping the level of the signal to that selected potential. Similarly, the transistor 192 conducts to clamp the signal to a minimum voltage level established by the position of the tap of the potentiometer 198. The tap of the potentiometer 198 is adjusted so that the upper and lower clamping potentials are the same except for their sign. Thus, the signal applied to the line 190 is a square wave, and has levels established at predetermined upper and lower limits which are compatible with the operation of the integrator 162.

When the switches 154 and 156 are in the position shown, the outputs of the integrating amplifiers 150 and 162 are selected for connection to the control lines 126 and 128. The inverters 152 and 168 are effective to invert the triangular waves generated in the amplifiers 150 and 162 and supply them, respectively, to the lines 130 and 108. These triangular waves are timed in such a way as to cause the voltage controlled amplifiers **92*a*–92*d* to be operative successively, each voltage controlled amplifier decreasing its gain during the rising portion of the triangular wave form to a minimum, and thereafter increasing its gain during the falling portion of the triangular wave form to a maximum. The gradual increase and decrease in amplitudes of the signals passed by the voltage controlled amplfiers in the group 92 is gradual enough to create the sensation to an observer within the space defined by the four loudspeakers 60, 68, 76, and 84 to perceive the source of the sound signal as moving gradually and continuously about the room in which the loudspeakers are located. If the four loudspeakers are located in a square, at positions corresponding to the angular designations indicated in FIG. 1, the sensation of the sound produced is circular movement around the room. The circuit arrangement illustrated in FIG. 1, using an FET 100 in conjunction with an operational amplifier 103,** produces an output power driving the loudspeakers which is proportional to the control voltage at the gate of the FET.

When the switches 148 and 166 are moved to their other position, the square wave outputs of the level shifters 146 and 158 are selected, and these are applied to the voltage controlled amplifiers in the group 92. Each voltage controlled amplifier is supplied with a square wave in phase quadrature with the square wave applied to the preceding and following voltage controlled amplifiers. Thus, each voltage controlled amplifier is turned fully on for half of each cycle and turned fully off for the other half cycle. Each control signal has a predetermined phase relation to the other control signals, so that the sound source represented by the four loudspeakers appears to move in a circular fashion, although more abruptly than with the triangular wave described above. Because of the overlapping nature of the square waves applied to adjacent loudspeakers, two loudspeakers are always energized with the same signal.

When the switch 156 is operated to its other condition, the phase of the control signals applied to the voltage controlled amplifiers for the 90° and 270° positions are interchanged, with the effect that the direction of circular rotation is reversed.

Moving the switch 154 to its other position changes the mode of operation from a circular progression from one loudspeaker to another to a figure 8 progression, in which, for example, the order of energization of the loudspeakers is 0°, 90°, 270°, 180°, 0°, etc. The direction of the progression is reversed by operation of the switch 156. The switches 154 and 156 determine the program of operation of the amplifiers 92.

The control unit which produces control outputs on lines 108, 126, 128, and 130 for controlling the voltage controlled amplifiers in the group 92 is identical to the channel control unit 50, which furnishes four control signals to the voltage controlled amplifiers in the group 48. Each of the control units has independent oscillators, such as the oscillator 142, so that the two groups of voltage controlled amplifiers can operate at independent program speeds. In addition, the switches 148 and 166 are supplied for both control units, so that some of the control signals may be triangular waves and others square waves, as desired, and are selected by the appropriate switches. In addition, switches such as the switches 154 and 156 are included in both control units, so that the two groups of voltage controlled amplifiers 48 and 92 may operate in the same or reverse direction, and either may operate in the circular or figure 8 mode, as desired by the operator.

When the switch 44 is closed the oscillator 40 is effective to repeatedly energize and de-energize the relay coil 34, to interchange the source of the audio signals between the groups of voltage controlled amplifiers 48 and 92. In this way, one of the input signals may be modulated in a circular fashion with the triangular wave for half of the time, and in a figure 8 fashion with a square wave the rest of the time. The input signals may be manually interchanged by operation of a switch 26, when automatic interchange between the two signal sources is not desired.

Figure 2:
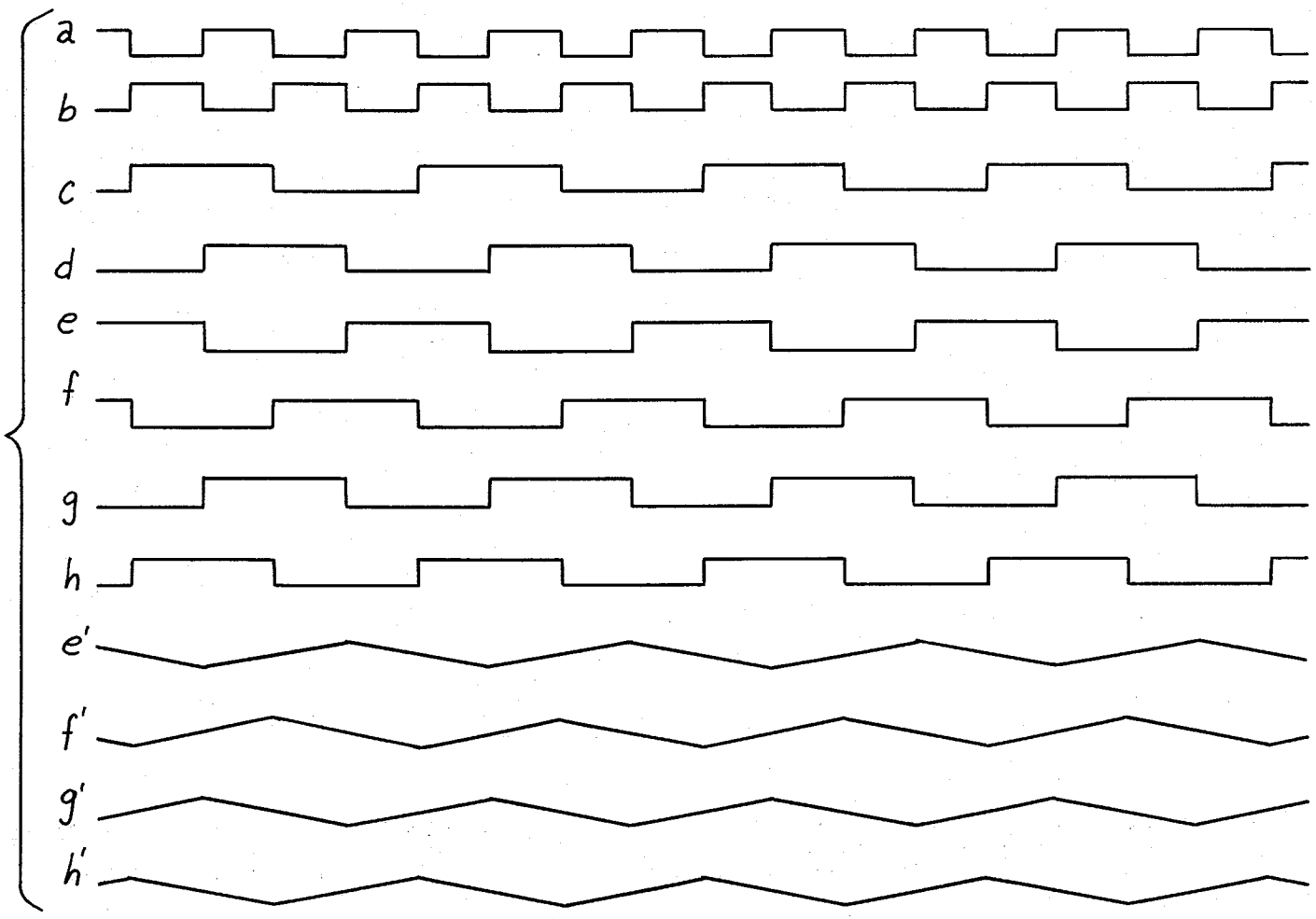
FIG. 2 is a graph illustrating a plurality of wave forms which occur at various points of the circuit of FIG. 1 during selected modes of operation.

In FIG. 2, wave forms of various signals produced at different points in the circuitry of FIG. 2 are illustrated and serve better to explain the phase relationship of the various signals. FIG. 2*a* is a wave form of signals which appear at the output of the flip-flop 138. FIG. 2*b* is a wave form of signals which appear at the output of the inverter 142, which is the inverted version of the wave form of FIG. 2*a*. The wave forms of FIGS. 2*c* and 2*d* represent the outputs of flip-flops 140 and 144, and it is evident from these wave forms that the states of the flip-flops 140 and 144 change at the end of each positive-going half cycle. Accordingly, the wave forms of FIGS. 2*c* and 2*d* are 90° out of phase.

The wave forms illustrated in FIGS. 2*e* and 2*f* are presented at the outputs of the level shifters 146 and 158, and they are seen to be the inverted wave forms illustrated in FIGS. 2*c* and 2*d*, with their level shifted. The wave forms illustrated at FIGS. 2*g* and 2*h* are the inverted wave forms of FIGS. 2*e* and 2*f*, with the same level. It is apparent that the wave forms illustrated in FIGS. 2*e*–2*h* each have an independent phase relationship, with each wave form displaced relative to the other two by 90°.

The wave forms of FIGS. 2*e'*–2*h'* represent the four outputs of the channel control unit when the triangular wave form is selected. It can be seen that the triangular waves are each provided with an individual phase relationship, in which each wave form is shifted by 90° relative to the preceding and following triangular waves.

In the above description, certain of the elements of the circuit have been illustrated in block diagram form. In a preferred embodiment of the present invention, the oscillators 40 and 132 are both integrated circuits such as type NE 555, which is commercially available from several commercial sources. Such as integrated circuit comprises a multivibrator which is capable of producing a square wave with a frequency controlled by an external resistor, such as the variable resistors 42 and 134. The flip-flops 138, 140, and 144 are conventional integrated circuit types and are preferably integrated circuit D flip-flops such as in type SN 7474. The various inverters and amplifiers which are illustrated are preferably type 741 operational amplifiers, which are integrated circuits commercially available from a variety of sources. The npn transistors are type 3904, and the pnp transistors are preferably type 3906. The field effect transistor is preferably a type 2N5163. All of the transistors are also commercially available from a variety of sources.

From the foregoing, it will be clear to those skilled in the art that the present invention is operative to control the sequence of energization of a plurality of loudspeakers in a predetermined programmed manner, in accordance with a selected program.

Although the foregoing description of the present invention is in terms of its use for converting an electrical signal into audible form by applying it to a plurality of loudspeakers, the present invention also lends itself to recording usage. As so used, one or more signal sources derived from microphones or the like are processed and the several output channels are connected by lines 210 to the inputs of a four-channel recording mechanism 212 where the channels are recorded on a multichannel record or on multi-track tape or equivalent matrix systems. When used in this manner, the interesting acoustic effects produced by use of the present invention are made at the recording site and are reproduced readily by conventional reproduction equipment.

When the present invention is used in connection with four-channel recording processes, the four loudspeakers illustrated in FIG. 1 are replaced by four recording heads, together with their associated equipment.

When a stereo recording is made in accordance with the present invention, the four output channels illustrated in FIG. 1 may be mixed by combining pairs of channels, so as to produce two output channels which may then be connected to drive the stereo recording apparatus. On playback, using a multichannel reproduction system, the illusion of a moving sound source, rotating or otherwise moving about the space defined by the four loudspeakers, is recreated.

Even more interesting and unusual effects are produced when sound signals are first recorded onto a four-channel recording medium using the present invention, and then played back using the present invention, with a separate control unit provided for each separate channel. Then the reproduction program, under the control of the oscillators and switches, like the switches 44, 154, and 156, may be made markedly different during recording and reproduction. This adds an entirely new dimension to any sound signals processed in this manner, and produces effects which are not realizable in any other way.

It will also be appreciated that the present invention, when employed with loudspeakers, is not limited to the use of four loudspeakers, but can be extended by the techniques of the present invention to any number of loudspeakers. At least three loudspeakers are required, however, to give a three dimensional moving effect.

In addition, the invention is not limited to the use of two signal inputs, such as are presented to the terminals 10 and 12, but may instead be used with a single channel if a monophonic source is available, or with more than two channels. When more than two channels are provided, each may be provided with an independent group of voltage controlled amplifiers and its own control unit, such as the control unit 50, so that each signal source is processed independently. The outputs of such additional groups of voltage controlled amplifiers are connected by isolation resistors to the inputs of the various mixers.

In a modification of the present invention, the multiple loudspeakers may be clustered together, pointing in different directions outwardly from a central point, rather than being located at the corners of a polygon, and much the same effect is perceivable to an observer. Either arrangement may be used by an individual instrument, such as an electronic organ, if desired.

In addition, the frequency of the oscillators like oscillator 132 may be synchronized with the music, instead of being freely adjustable by the variable resistor 134. Synchronizable oscillators are well known, and therefore need not be described in detail. The synchronizing pulses may be derived mechanically when the present invention is employed during the recording of live music, by providing a switch on a drum or other rhythm instrument which is closed in a regular recurring pattern in time with the music. Alternatively, the switch which produces the synchronizing pulse may be operated by a piano pedal, etc.

In the alternative, a synchronization signal may be derived from an input signal by passing the signal through a frequency selective filter and then using the peaks of the signal produced at the output of such filter for synchronizing.

Although the integrators and the voltage controlled amplifiers have been described as analog units, it will be obvious to those skilled in the art that comparable digital units may be used instead.

It will be apparent that various other modifications and additions may be made in the present invention without departing from the essential features of novelty thereof, which are intended to be defined and secured by the appended claims.

What is claimed is:

1. Apparatus for processing a plurality of sound signals including first and second groups of voltage controlled amplifiers, each of said voltage controlled amplifiers having signal input, a control input, and an output, means for connecting the signal input of each of the voltage controlled amplifiers in said first group to a first signal source, means for simultaneously connecting the signal input of each of the voltage controlled amplifiers in said second group to a second signal source, first control means connected to the amplifiers of said first group for energizing said amplifiers of said first group in a predetermined sequence, said first control means comprising means for producing a first plurality of a.c. control signals having the same frequency but separated in phase by equal increments, means for connecting said first plurality of control signals individually to the control inputs of the voltage controlled amplifiers of said first group, second control means comprising means for producing a second plurality of a.c. control signals independent of the signals produced by said first control means, said means for connecting each of said second plurality of control signals individually to the voltage controlled amplifiers of said second group, said first and second control means each including oscillator means for generating a signal at a predetermined frequency, selectively operable means for adjusting said predetermined frequency independently in said first and second control means, means connected to said oscillator means for deriving said plurality of a.c. control signals, and mixer means connected to the outputs of the amplifiers of said first and second groups for mixing output signals from corresponding ones of said plurality of amplifiers in said first and second groups to produce combined output signals on a plurality of output channels.

2. Apparatus for processing a plurality of sound signals including a first group of voltage controlled amplifiers, means for connecting a signal input of each of the voltage controlled amplifiers in said group to a first signal source, first control means connected to the amplifiers of said first group for energizing said amplifiers of said first group in a predetermined sequence, a second group of voltage controlled amplifiers, means for connecting each of the voltage controlled amplifiers in said second group to a second signal source, second control means connected to the amplifiers of the second group for energizing the amplifiers of the second group in a predetermined sequence, a plurality of mixers, each having inputs connected to the output of an amplifier of said first group and to an amplifier of said second group, said first control means comprising means for producing a plurality of a.c. control signals having the same frequency but separated in phase by equal increments, means for connecting each of said control signals individually to a voltage controlled amplifier, said second control means comprising means for providing a second plurality of a.c. control signals independent of the signals produced by said first control means, and means for connecting each of said second plurality of control signals individually to a voltage controlled amplifier of said second group.

3. Apparatus according to claim 2, wherein said first and second groups of voltage controlled amplifiers each include four amplifiers, and the first and second groups of a.c. control signals comprise four signals in phase quadrature.

4. Apparatus according to claim 2, wherein said first and second control means each include selectively operable means for selecting a.c. control signals having predetermined wave shapes for connection to said voltage controlled amplifiers.

5. Apparatus according to claim 2, wherein said first and second control means each include selectively operable means for selecting a predetermined sequence of operation of said voltage controlled amplifiers.

6. Apparatus according to claim 2, wherein said first and second control means each include means for producing said signals with a duration such that two of said voltage controlled amplifiers of each of said groups are energized at any given time.

7. Apparatus according to claim 2, including multichannel recording means, and means connecting each of said voltage controlled amplifiers with said recording means for recording the output of said amplifier in an individual recording channel.

8. Apparatus according to claim 2, wherein said first control means comprises means for generating a square wave, integrator means connected to receive said square wave for developing a symmetrical triangular wave having the same frequency as said square wave, and adjustable means connected with said integrator for permitting adjustment of the slope of the output of said integrator.

9. Apparatus according to claim 8, wherein said square wave generator incorporates an oscillator, manually adjustable means connected with said oscillator for varying the output frequency of said oscillator, and means for connecting together said manually adjustable means and said slope determining means for adjusting the slope of said integrator simultaneously with adjustments of the frequency of said oscillator, to maintain a symmetrical triangular waveform as a frequency of such waveform is changed.

10. Apparatus according to claim 2, wherein said first control means comprises square wave generator means for producing two output square waves in overlapping phase with each other, and including means for connecting the first of said square waves to one of said voltage controlled amplifiers and for connecting said second square wave to a second voltage controlled amplifier, whereby said voltage controlled amplifiers are controlled in overlapping sequence.

11. Apparatus according to claim 2, wherein said voltage controlled amplifiers each comprise an amplifier having an input connected to a signal source and an output directly coupled through an amplifier to a loudspeaker for causing said loudspeaker to produce sounds in response to said signal source in accordance with the operation of said voltage controlled amplifier, said voltage controlled amplifier being controlled by a voltage from said first control means for selectively attenuating the signal connected between said signal source and said loudspeaker.

12. Apparatus according to claim 2, wherein said first control means comprises a variable frequency oscillator for producing an a.c. control signal at a manually selectable frequency, and pilot lamp means connected with said oscillator for visually indicating the frequency of oscillating of said oscillator.

13. Apparatus according to claim 2, including means for connecting the signal input of each of said amplifiers of said second group to a second signal source, second control means connected to the amplifiers of said second group for energizing said amplifiers of said second group in a predetermined sequence, and means for selectively interchanging the first and second signal inputs connected to the first and second groups of voltage controlled amplifiers.

14. Apparatus according to claim 13, including an oscillator, means for controlling the frequency of oscillation of said oscillator, and means for connecting the output of said oscillator to said switch means for sequentially interchanging the positions of said first and second signals in relation to said first and second group of amplifiers.

15. Apparatus according to claim 14, including pilot lamp means, and means for connecting said pilot lamp to said oscillator for visually indicating the frequency of operation of said oscillator.

16. A method of processing multichannel sound signals with first and second groups of voltage controlled amplifiers, comprising the steps of: applying a first source of a sound signal to the signal inputs of all of the voltage controlled amplifiers in said first group, applying a second source of a sound signal to the signal inputs of all of the voltage controlled amplifiers in said second group, generating first and second independent sets of control signals for controlling said voltage controlled amplifiers, successively energizing said amplifiers of said first group with said first set of control signals for successively connecting said first sound signal source to a first plurality of output channels individually connected to said amplifiers, successively energizing said amplifiers of said second group with said second set of control signals for successively connecting said second sound signal source to a second plurality of output channels individually connected to said amplifiers, mixing signals from pairs of output channels including one output channel from said first set and one output channel from said second set, to provide a plurality of combined output signal channels, and connecting said combined output signal channels individually to a plurality of transducers.

17. The method according to claim 16, including the step of connecting said channels to a multichannel recording means.

18. The method according to claim 16, including the steps of providing a plurality of mixers for mixing the outputs of corresponding ones of the amplifiers of said first and second groups, and means for connecting said mixers individually to a plurality of transducers, operating said amplifiers of said first group of amplifiers in sequential fashion to sequentially energize corresponding ones of said transducers, and operating said amplifiers of said second group with a second sequence for successively connecting said second signal source to successive transducers, and selecting the sequence of operation of the amplifiers of said second group independently of the sequence of operation of the amplifiers of said first group.

19. The method according to claim 18, including the steps of selecting a first frequency for operation of the amplifiers of said first group, whereby said amplifiers are energized successively at a rate corresponding to said first frequency, selecting a first order of sequence for the amplifiers of said first group, whereby said amplifiers of said first group are operated in a sequence corresponding to said selected sequence, selecting a second frequency for operation of the amplifiers of said second group, whereby said amplifiers are energized sequentially at a rate corresponding to said second frequency, and selecting a second sequence for the operation of the amplifiers of said second group, whereby the amplifiers of said second group are energized sequentially in accordance with said second sequence, said first and second frequencies and said first and second sequences being independent of each other.

20. The method according to claim 19, wherein said transducers comprise recording transducers whereby the signals passed by said mixers are recorded to allow subsequent reconstruction as independent signals.

* * * * *